US010253455B2

(12) United States Patent
Duhen et al.

(10) Patent No.: US 10,253,455 B2
(45) Date of Patent: Apr. 9, 2019

(54) WEB OF CELLULOSIC FIBERS COMPRISING AN ACTIVE AGENT AND METHOD FOR MANUFACTURING A WEB OF CELLULOSIC FIBERS COMPRISING AN ACTIVE AGENT

(71) Applicant: SCA TISSUE FRANCE, Saint-Ouen (FR)

(72) Inventors: Gérald Duhen, Andolsheim (FR); Philippe Malgarini, Gunsbach (FR); Cyril Schu, Wickerschwihr (FR); Nicolas Marquine, Muntzenheim (FR)

(73) Assignee: ESSITY OPERATIONS FRANCE, Saint-Ouen (FR)

( * ) Notice: Subject to any disclaimer, the term of this patent is extended or adjusted under 35 U.S.C. 154(b) by 306 days.

(21) Appl. No.: 14/905,301

(22) PCT Filed: Jul. 22, 2013

(86) PCT No.: PCT/IB2013/001714
§ 371 (c)(1),
(2) Date: Jan. 15, 2016

(87) PCT Pub. No.: WO2015/011512
PCT Pub. Date: Jan. 29, 2015

(65) Prior Publication Data

US 2016/0160443 A1 Jun. 9, 2016

(51) Int. Cl.

| | |
|---|---|
| ***D21H 23/22*** | (2006.01) |
| ***D21H 19/20*** | (2006.01) |
| ***D21H 17/56*** | (2006.01) |
| ***D21H 19/10*** | (2006.01) |
| ***D21H 17/37*** | (2006.01) |
| ***D21H 17/36*** | (2006.01) |
| ***D21H 17/35*** | (2006.01) |
| ***D21H 21/36*** | (2006.01) |
| ***D21H 27/00*** | (2006.01) |
| ***D21H 17/00*** | (2006.01) |
| ***D21F 5/18*** | (2006.01) |

(52) U.S. Cl.
CPC ..... *D21H 5/22* (2013.01); *D21F 5/181* (2013.01); *D21H 3/00* (2013.01); *D21H 17/35* (2013.01); *D21H 17/36* (2013.01); *D21H 17/37* (2013.01); *D21H 17/56* (2013.01); *D21H 17/72* (2013.01); *D21H 19/10* (2013.01); *D21H 19/20* (2013.01); *D21H 21/36* (2013.01); *D21H 23/22* (2013.01); *D21H 27/002* (2013.01); *D21H 27/004* (2013.01)

(58) Field of Classification Search
None
See application file for complete search history.

(56) References Cited

U.S. PATENT DOCUMENTS

| | | | | |
|---|---|---|---|---|
| 4,615,937 | A * | 10/1986 | Bouchette | A01N 25/34 15/209.1 |
| 7,879,188 | B2 | 2/2011 | Dyer et al. | |
| 2004/0161450 | A1 | 8/2004 | Buder | |
| 2012/0141570 | A1* | 6/2012 | Buder | A01N 31/08 424/414 |
| 2012/0164206 | A1 | 6/2012 | Soerens et al. | |

FOREIGN PATENT DOCUMENTS

| | | | |
|---|---|---|---|
| CN | 101107398 | A | 1/2008 |
| EP | 0228710 | A1 | 7/1987 |
| JP | 2003-201700 | A | 7/2003 |
| RU | 2409303 | C2 | 1/2011 |
| RU | 2409303 | C9 | 5/2011 |
| WO | WO-87/01400 | A1 | 3/1987 |
| WO | WO-2005/023945 | A2 | 3/2005 |
| WO | WO-2006/014446 | A1 | 2/2006 |
| WO | WO 2007/075356 | A2 | 7/2007 |
| WO | WO-2011/085499 | A1 | 7/2011 |
| WO | WO-2013/019833 | A1 | 2/2013 |

OTHER PUBLICATIONS

Mexican Office Action Folio No. 90381 dated Dec. 11, 2017 issued in corresponding Mexican patent application No. MX/a/2016/000832 (5 pages) and its partial English-language translation thereof (5 pages).

English-language translation of Russian Decision on Grant dated Aug. 31, 2017 issued in corresponding Russian patent application No. 2016105698 (5 pages).

First Moroccan Office Action dated May 4, 2017 issued in corresponding Moroccan patent application No. 338713 (6 pages) and its partial English-language translation thereof (1 page).

English-language translation of Russian Office Action dated May 25, 2017 issued in corresponding Russian patent application No. 2016105698 (3 pages).

English-language translation of a Second Chinese Office Action dated Jul. 18, 2017 issued in corresponding Chinese patent application No. 201380078281.6 (11 pages).

European Office Communication dated Jul. 19, 2017 issued in corresponding European patent application No. 13 770 702.2 (3 pages).

* cited by examiner

*Primary Examiner* — Sheeba Ahmed
(74) *Attorney, Agent, or Firm* — Drinker Biddle & Reath LLP

(57) ABSTRACT

A web including cellulosic fibers having two sides and including an additive composition present on at least one side of the web and a method of making such a web are disclosed. The additive composition includes at least one filming agent and at least one active agent, the filming agent being fixed on the web and the active agent being retained on the web by the filming agent, the active agent being an antimicrobial agent.

11 Claims, 3 Drawing Sheets

WEB OF CELLULOSIC FIBERS COMPRISING AN ACTIVE AGENT AND METHOD FOR MANUFACTURING A WEB OF CELLULOSIC FIBERS COMPRISING AN ACTIVE AGENT

CROSS-REFERENCE TO PRIOR APPLICATION

This application is a § 371 National Stage Application of PCT International Application No. PCT/IB2013/001714 filed Jul. 22, 2013, which is incorporated herein in its entirety.

TECHNICAL FIELD

The present disclosure relates to a web including cellulosic fibers, in particular a sheet of absorbent paper. The disclosure also relates to the application of an active agent such as an antimicrobial, antibacterial or antifungal agent on a web retained on it by a filming agent.

BACKGROUND

For some applications, one tries to make tissue paper or generally fiber web, with antimicrobial properties, especially antibacterial properties. The tissue paper or generally fiber web can include tissues or wiping products, such as paper towels, hand towels, handkerchiefs, facial tissues, toilet tissues, napkins, cotton pads, baby pads . . . .

Some antimicrobial papers exist where a portion of antimicrobial agent is released when the paper is wetted as it is disclosed by WO2011/085499. Then, the delivered antimicrobial agent is able to kill pathogens. This sort of paper is efficient in its field, however precautions need to be taken concerning the release of chemicals and particularly nowadays that people are more concerned with problems of allergy, sensitization, toxicity and pollution.

According to another state of the art, US 2012/0164206, in order to avoid the release of chemicals, other tissue papers contain a positively charged bacteriostatic composition that attracts and retains negatively charged bacteria but may not kill them. While these tissue papers are useful under certain conditions, in some cases, it is really necessary to kill all pathogens and to be sure that there will not be any possibility of contamination.

Thus, a clear need exists for a web that can kill the pathogens without releasing the active agent. There is also a need of a method to apply an active agent onto a web to obtain such a product.

SUMMARY

In a first aspect, a web includes cellulosic fibers having two sides and includes an additive composition present on at least one side of the web. The additive composition includes at least one filming agent and at least one active agent, the filming agent being fixed on the web and the active agent being retained on the web by the filming agent, the active agent being an antimicrobial agent.

In certain embodiments, the active agent is trapped on the web and is not released outside of the web, the release being measured in accordance with the NF EN ISO 1104 standard.

According to an embodiment, the amount of filming agent present on the final product is between 0.01 weight % and 2 weight %, or between 0.01 to 1 weight %, and the amount of active agent present on the final product is between 0.005 weight % and 2 weight %, between 0.01 weight % to 1 weight %, or between 0.02 weight % to 0.05 weight %.

According to an embodiment, the filming agent is an agent that has a good affinity with the fibers of the web, permitting its fixation on them and that undergoes a change of state from liquid to solid when a sufficient temperature is reached by mechanism of cross-linking or by solvent evaporation for example. Consequently, the active agent is trapped in the structure and cannot be released in normal use, while remaining efficient. It is considered that there is no release when in performing the test method according to the NF EN ISO 1104 standard, no inhibition around the sample of web is detected with the naked eye. The absence of release of the active agent is a major advantage of such products. Indeed, this eliminates the transfer of chemicals and decreases the risk of allergy, sensitization, toxicity or pollution. Moreover, as they are not biocides, they are not subject to special regulation.

It has to be noted that the resulting film is a molecular layer on the cellulosic fibers located on the at least one side of the web. In other words, the thickness of this film is very thin, in the range of Angström unit and is located at the surface of the cellulosic fibers present on the side of the web.

The filming agent is a polymer or a copolymer or a mixture that permits to retain the active agent on the web. In particular, it can include a non-water soluble polymer or a non-water soluble copolymer. A list of such polymers and copolymers will be detailed below.

According to an embodiment, the filming agent includes from 30 to 100% of non-water soluble polymer, copolymer or mixture thereof and from 0 to 30% of water-soluble polymer, copolymer or mixture thereof. A list of such water-soluble polymers and copolymers will be detailed below.

The active agent can be an antimicrobial agent, such as an antibacterial or antifungal agent or any combination thereof. In certain embodiments, an antimicrobial agent is an agent that can kill microorganisms, such as bacteria (antibacterial) and fungi (antifungal). A list of such agents will be detailed below.

When the active agent is an antibacterial or an antifungal agent, the efficiency of the final product is at least about 60% after one hour, or at least 80%. The efficiency is measured according to a method described later in the examples.

A good efficiency remains while low quantities of additive composition and consequently low quantities of active agent are applied. Indeed, even if the active agent is trapped by the filming agent and used in low quantity, the active agent still remains efficient. In the case of an antibacterial or antifungal agent, the efficiency of the web is higher than 80%. Moreover, a web made according to embodiments of the invention was founded to remain efficient on long term. The antibacterial efficiency was measured on a web made 1.5 years ago and it remained higher than 60%. Thus, it is a significant advantage to be able to use so little additive composition and however obtain a web that remains efficient on short and long term. This efficiency will be more appreciated with later examples.

In certain embodiments, the web includes cellulosic fibers. It can be a non-woven web or an airlaid paper or a wetlaid paper sheet and has a basis weight between 10 and 200 g/m$^2$. In particular embodiments, the web includes at least 50% of cellulosic fibers, natural or artificial, the other fibers where appropriate being synthetic.

An airlaid paper sheet is a paper sheet manufactured by a papermaking process using dry papermaking fibers that are bonded by means of a thermoplastic binder such as latex (ethylene/vinyl acetate copolymer) or thermally binding fibers, while a wetlaid paper sheet is a paper sheet manufactured by a papermaking process using papermaking fibers suspended in water and the process being either Conventional Wet Process (CWP) or a Through Air Drying Process (TAD). It can be a sheet of tissue paper with a basis weight between 10 and 80 g/m$^2$. The web can be a single ply or multi ply, and it can be used as Away-from-Home products or consumer products, such as, for example, handkerchiefs, facial tissue, paper towels, toilet paper, napkins, cotton pads, or as a component of hygiene products (diapers and feminine hygiene products).

In another aspect, a method of manufacturing a web comprises the steps of:

applying said additive composition onto a web of cellulosic fibers, said additive composition including at least one filming agent and at least one active agent and said additive composition being in suspension in a solvent, such as water, heating the web at a sufficient temperature to fix said filming agent on the web and said active agent being retained on the web by said filming agent.

In particular embodiments, the additive composition is applied while in suspension in solvent, such as water.

In certain embodiments, said additive composition is in suspension in water, the suspension including at least 5% of water, 0.1 weight % to 20 weight % of each filming agent and 0.15 weight % to 50 weight % of each active agent, the ratio between the filming agent and the active agent being in the range of 1 to 10.

The additive composition can be applied on a semi finished web product or at any steps of the manufacture of a web, upstream of said step of heating.

The temperature of the step of heating should be sufficient to provide a change of state of the filming agent from liquid to solid by a mechanism of cross-linking or by solvent evaporation. This change of state permits the trapping of the active agent that thereafter is not released.

According to an embodiment, the range of the temperature is between 50° C. and 200° C., or between 80° C. and 120° C.

According to certain embodiments, the web is heated at least on one heating cylinder or by metal plate or by infrared or by a through air dryer or by micro-wave or by any other pertinent heating systems. The heating cylinder can be heated by induction, steam, oil. This step of heating will be explained in more details below.

According to an embodiment of the method, the web is a tissue paper sheet and the additive composition is applied directly or indirectly on said sheet of tissue paper while the sheet is in the papermaking machine, said machine including a Yankee cylinder for drying the sheet, wherein the additive composition is applied:

directly on the sheet upstream of the Yankee cylinder, or/and on the surface of the Yankee cylinder, the additive composition being transferred then on the sheet while the latter is dried on the surface of the Yankee cylinder, or/and directly on the sheet of paper adhered on the surface of the Yankee cylinder, or/and directly on the sheet of paper downstream of the Yankee cylinder.

The application of the additive composition upstream of the Yankee cylinder or at the level of the Yankee cylinder has the advantage of combining the steps of drying the web and heating the web to provide a change of state of the filming agent in order to retain the active agent on the web.

In the case of an application of the additive composition downstream of the Yankee cylinder, an additional step of heating the web is necessary to fix the additive composition on the web.

According to an embodiment, the amount of additive composition is in the range of 0.05 to 3% of dry weight of the product, or in the range of 0.1 to 1% of dry weight.

In embodiment where the tissue paper sheet is adhered on the surface of the Yankee cylinder with a coating composition, the additive composition is advantageously incorporated into the coating composition sprayed onto the Yankee cylinder. The coating composition includes adhesive agents that permit the web to adhere to the cylinder and release agents that allow peeling and creping of the web. This solution avoids using additional water for the suspension of the additive, the dilution of the additive composition being the same as the one of the coating composition.

According to another embodiment, the additive composition is also applied on the cylinder separately from the composition of coating.

According to another embodiment, the additive composition is sprayed onto a cylinder.

In another aspect, a product includes at least one ply made of a web as described previously.

BRIEF DESCRIPTION OF THE FIGURES

A method according to embodiments of the invention is described in detail below with reference to the drawings wherein like numbers designate similar parts and wherein:

FIG. 4 includes FIGS. 4*a* and 4*b* that are schematic diagrams of a section of a first papermachine showing an embodiment for applying an additive composition on a Yankee cylinder;

DETAILED DESCRIPTION OF PARTICULAR EMBODIMENTS

Figure 1A:
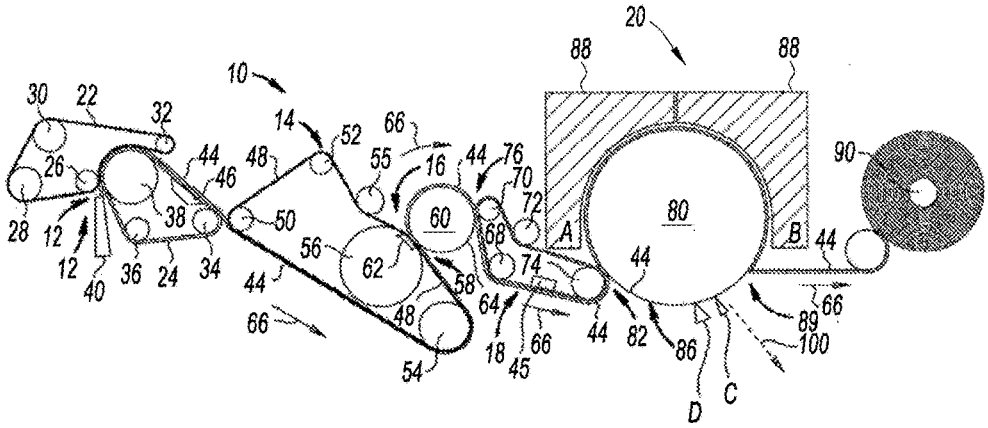
FIG. 1*a* is a schematic diagram of a Conventional Wet Process papermachine.

FIG. 1*a* is a schematic diagram of a conventional wet process (CWT) papermaking machine 10 having a forming section with conventional twin wire forming section 12 or suction breast roll or crescent former, a felt run 14, a creping fabric 18 and a Yankee dryer 20.

Other options include: an intermediate step with a shoe press, Through Air Drying technologies (conventional with one or two TAD rolls (FIG. 1*b*), ATMOS technology), Air Laid machine.

Forming section 12 includes a pair of forming fabrics 22, 24 supported by a plurality of rolls 26, 28, 30, 32, 34, 36 and a forming roll 38. A headbox 40 provides papermaking furnish issuing therefrom as a jet in the machine direction to a nip 42 between forming roll 38 and roll 26 and the fabrics. The furnish forms a nascent web 44 which is dewatered on the fabrics with the assistance of vacuum, for example, by way of suction box 46.

The nascent web is advanced to a papermaking felt 48 which is supported by a plurality of rolls 50, 52, 54, 55 and the felt is in contact with a shoe press roll 56. The web is of low consistency as it is transferred to the felt. Transfer may be assisted by vacuum; for example roll 50 may be a vacuum roll if so desired or a pickup or vacuum shoe as is known in the art. As the web reaches the shoe press roll it may have a consistency of 10-25 percent, or 20 to 25 percent or so as it enters nip 58 between shoe press roll 56 and transfer roll 60. Transfer roll 60 may be a heated roll if so desired. It has been found that increasing steam pressure to roll 60 helps lengthen the time between required stripping of excess adhesive from the cylinder of Yankee dryer 20.

Instead of a shoe press roll, roll 56 could be a conventional suction pressure roll. If a shoe press is employed, it is desirable that roll 54 is a vacuum roll effective to remove water from the felt prior to the felt entering the shoe press nip since water from the furnish will be pressed into the felt in the shoe press nip. In any case, using a vacuum roll at 54 is typically desirable to ensure the web remains in contact with the felt during the direction change as one of skill in the art will appreciate from the diagram.

Web 44 is wet-pressed on the felt in nip 58 with the assistance of pressure shoe 62. The web is thus dewatered at 58, typically by increasing the consistency by 15 or more points at this stage of the process. The configuration shown at 58 is generally termed a shoe press; cylinder 60 is operative as a transfer cylinder which operates to convey web 44 at high speed to the creping fabric.

Cylinder 60 has a smooth surface 64 which may be provided with adhesive, (the same as the creping adhesive coating used on the Yankee cylinder) and/or release agents if needed. Web 44 is adhered to transfer surface 64 of cylinder 60 which is rotating at a high angular velocity as the web continues to advance in the machine-direction indicated by arrows 66. On the cylinder, web 44 has a generally random apparent distribution of fiber.

Direction 66 is referred to as the machine-direction (MD) of the web as well as that of papermachine 10; whereas the cross-machine-direction (CD) is the direction in the plane of the web perpendicular to the MD.

Web 44 enters nip 58 typically at consistencies of 10-25 percent or so and is dewatered and dried to consistencies of from about 25 to about 70 by the time it is transferred to creping fabric 18 as shown in the diagram.

Fabric 18 is supported on a plurality of rolls 68, 70, 72 and a press nip roll 74 and forms a fabric crepe nip 76 with transfer cylinder 60 as shown.

The creping fabric defines a creping nip over the distance in which creping fabric 18 is adapted to contact roll 60; that is, applies significant pressure to the web against the transfer cylinder. To this end, backing (or creping) roll 70 may be provided with a soft deformable surface which will increase the length of the creping nip and increase the fabric creping angle between the fabric and the sheet and the point of contact or a shoe press roll could be used as roll 70 to increase effective contact with the web in high impact fabric creping nip 76 where web 44 is transferred to fabric 18 and advanced in the machine-direction.

After fabric creping, the web continues to advance along MD 66 where it is wet-pressed onto Yankee cylinder 80 in transfer nip 82. Optionally, the web is treated by way of a suction box 45.

Transfer at nip 82 occurs at a web consistency of generally from about 25 to about 70 percent. At these consistencies, it is difficult to adhere the web to surface 84 of cylinder 80 firmly enough to remove the web from the fabric thoroughly.

The coatings cooperate with a moderately moist web (25-70 percent consistency) to adhere it to the Yankee sufficiently to allow for high velocity operation of the system and high jet velocity impingement air drying and subsequent peeling of the web from the Yankee.

In this connection, an appropriate aqueous coating composition is applied at 86 as needed. The coating composition may be applied using spray booms.

The web is dried on Yankee cylinder 80 which is a heated cylinder and by high jet velocity impingement air in Yankee hood 88. Hood 88 is capable of variable temperature. During operation, temperature may be monitored at wet end A of the Hood and dry end B of the hood using an infra-red detector or any other suitable means if so desired. As the cylinder rotates, web 44 is peeled from the cylinder at 89 and wound on a take-up reel 90. Reel 90 may be operated faster than the Yankee cylinder at steady-state. A creping doctor C is normally used and a cleaning doctor D mounted for intermittent engagement is used to control build up. When adhesive build-up is being stripped from Yankee cylinder 80 the web is typically segregated from the product on reel 90, such as being fed to a broke chute at 100 for recycle to the production process.

Instead of being peeled from cylinder 80 at 89 during steady-state operation as shown, the web may be creped from dryer cylinder 80 using a creping doctor such as creping doctor C, if so desired.

Figure 1B:
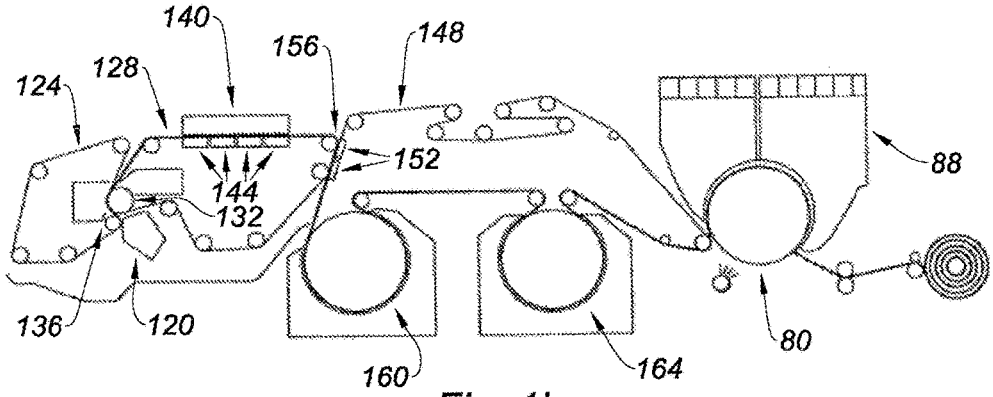
FIG. 1*b* is a schematic diagram of a Through Air Drying papermachine.

According to embodiments, the manufacturing process can also include a TAD process as shown in FIG. 1*b*, with two TAD rolls 160 and 164 upstream of a Yankee cylinder 80.

According to embodiments, an additive composition includes at least one filming agent and at least one active agent is applied at any step of the manufacture followed by a step of heating at a sufficient temperature so that the filming agent retains the active agent on the web. The additive composition can be applied while in suspension in water and the suspension includes 0.1 to 20 weight % of each filming agent and 0.15 to 50 weight % of each active agent. The remaining is at least 5 weight % of water. The ratio between the filming agent and the active agent is in the range of 1 to 10.

According to embodiments, the filming agent is an agent that undergoes a change of state when a sufficient temperature is reached, i.e. it goes from liquid to solid by a mechanism of cross-linking or by solvent evaporation. Consequently the active agent is trapped and retained on the web while remaining efficient.

According to embodiments, the filming agent can be selected from a group of known compounds usually used for this property. In an embodiment, the filming agent substantially includes a non-water soluble polymer or a non-water soluble copolymer selected from the group consisting of polyacrylate, poly(vinyl)acetate, copolymer of acrylate and vinylacetate, copolymer of poly(acrylate) and vinylacetate, poly(vinylalcohol) of very high molecular weight, copolymer of vinyl alcohol and vinyl acetate, polyamine-amide epychlorhydrin, as well as copolymers which contain the monomeric elements of the said polymers. Mixtures of the said polymers and copolymers are also suitable. In a particular embodiment, the filming agent is a copolymer of acrylate and vinylacetate or a mixture of poly(acrylate) and poly(vinylacetate).

According to an embodiment, the filming agent includes from 30 to 100% of non-water soluble polymer, copolymer or mixture thereof and from 0 to 30% of water-soluble polymer, copolymer or mixture thereof.

The water-soluble polymer or copolymer is selected in the group consisting of polyvinylpyrrolidone, copolymer of vinyl pyrrolidone and vinyl acetate, water soluble cellulose derivative, poly(vinylalcohol) of low and medium molecular weight, polyethylenimine, or a mixture of said polymers and copolymers.

According to embodiments, the active agent can be an antimicrobial agent, such as an antibacterial, antifungal agent or any combination thereof.

One skilled in the art will appreciate that the activity of the active agent will depend of the nature of the agents used. In an embodiment, the active agent is an antimicrobial agent, such as an antibacterial or antifungal agent selected from the group consisting of benzalkonium chloride, dodecyl dimethyl ammonium chloride, cetylpyridinium chloride, hexadecyl trimethyl ammonium bromide, chlorhexidine, hexamidine, phenoxyethanol, triclosan, silver salts, zinc salts and a mixture of said active agents.

To increase the anti-microorganism spectrum and to create a synergy effect, a mixture of said active agents is conceivable.

In a particular embodiment, the active agent is benzalkonium chloride and it can be associated with other agents, such as silver nitrate.

In another embodiment, the active agent can be phenoxyethanol.

It is appreciated that one skilled in the art can select one of the active agent or make a combination of several said active agents, depending on the expected activity.

The web has a first side and a second side and the additive composition can be applied on one side or both sides of the web. When the additive composition is applied on only one side of the web, the efficiency is already very high. And when the additive composition is also present on the second side in addition to the first side, the web is efficient on both sides. There is no need to select the good side of the web to have a good efficiency.

Thus, in the case of an antibacterial or an antifungal agent, if the amount of additive composition present on the final product is between 0.05 and 3 weight %, the efficiency of the final product is at least about 60% after 1 h, or at least 80%. In particular embodiments, an amount of additive composition present on the final product is in the range of 0.1 to 1% of dry weight.

According to the embodiment shown in FIG. 1, a non-woven web is obtained including cellulosic fibers, it can be a single ply or a multi-ply. Such web is used in the manufacture of Away-from-Home products including paper towels, toilet paper, napkins, facial tissue, wipes dedicated to hotels, restaurants, offices, industry, healthcare . . . and also in the manufacture of consumer products such as handkerchiefs, facial tissue, paper towels, toilet paper, napkins . . . . In these cases, the basis weight of the sheet of paper is between 10 and 80 g/m$^2$.

Others embodiments can be envisaged to obtain non-woven cotton web for example that can be used as cotton pads for medical or cosmetic use, to remove or apply make up or clean babies, without to be selective.

Such web can also be used as a component of diapers and feminine hygiene products.

According to embodiments, the additive composition can be applied during the papermaking step or during the converting step.

The FIGS. 2 to 6 show examples of embodiments, wherein the location of application will be better understood.

Figure 2:
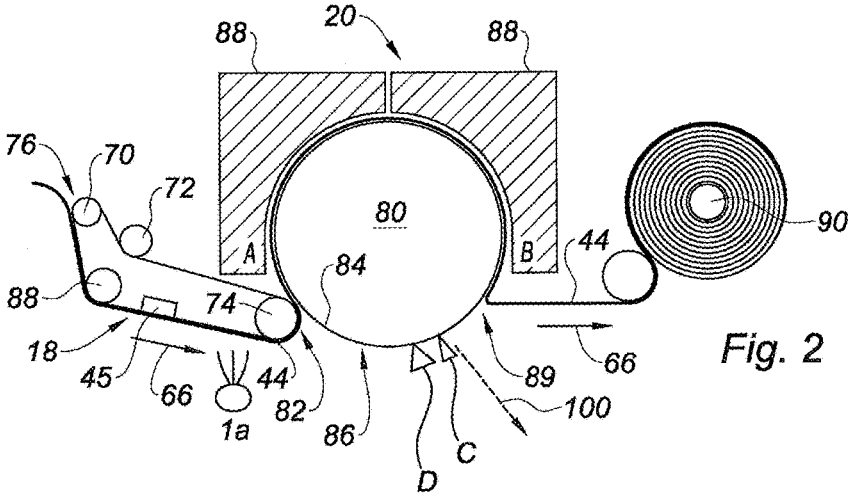
FIG. 2 is a schematic diagram of a section of a first papermachine showing an embodiment for applying an additive composition on a web upstream of a Yankee cylinder.

FIG. 2 shows a possible embodiment wherein the additive composition is applied during the papermaking step upstream of the Yankee cylinder 80. The additive composition applicator 1*a* is located at the creping fabric 18, upstream of the transfer nip 82.

Figure 3:
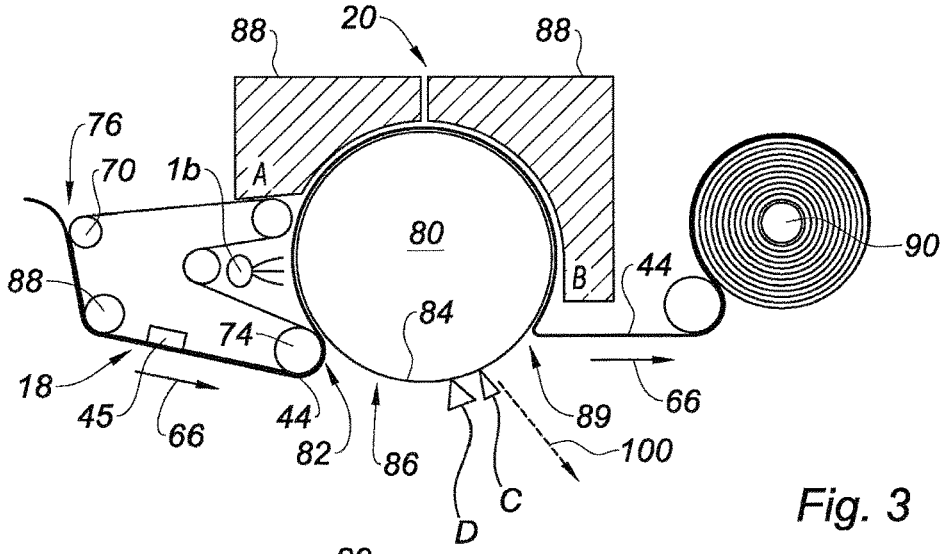
FIG. 3 is a schematic diagram of a section of a first papermachine showing an embodiment for applying an additive composition on a web at a Yankee cylinder.
Figure 4A:
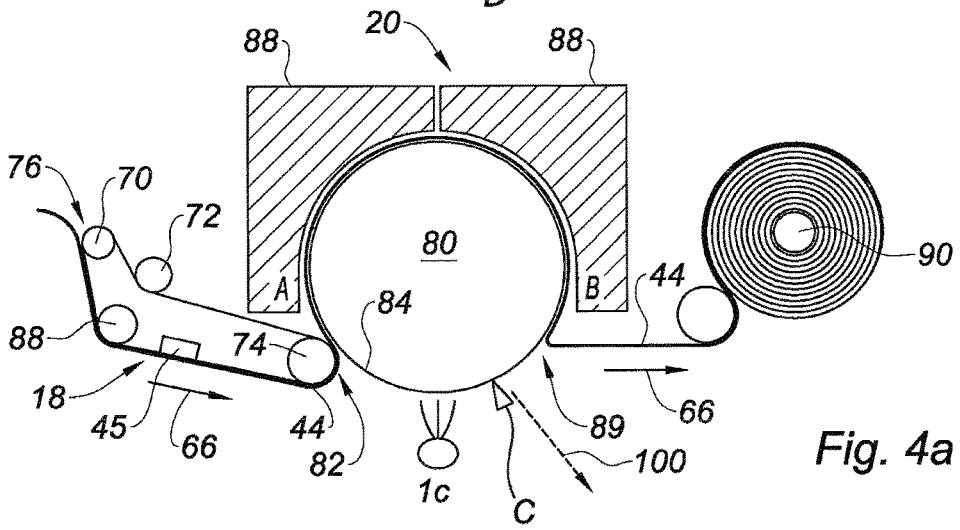
FIG. 4*a* shows the additive composition incorporated to the coating composition.
Figure 4B:
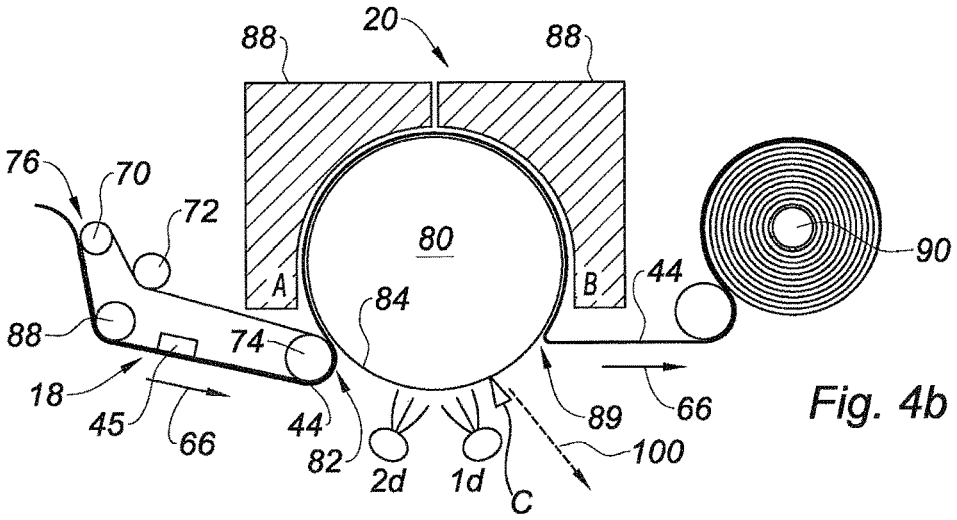
FIG. 4*b* shows the additive composition and the coating composition are applied separately.
Figure 5:
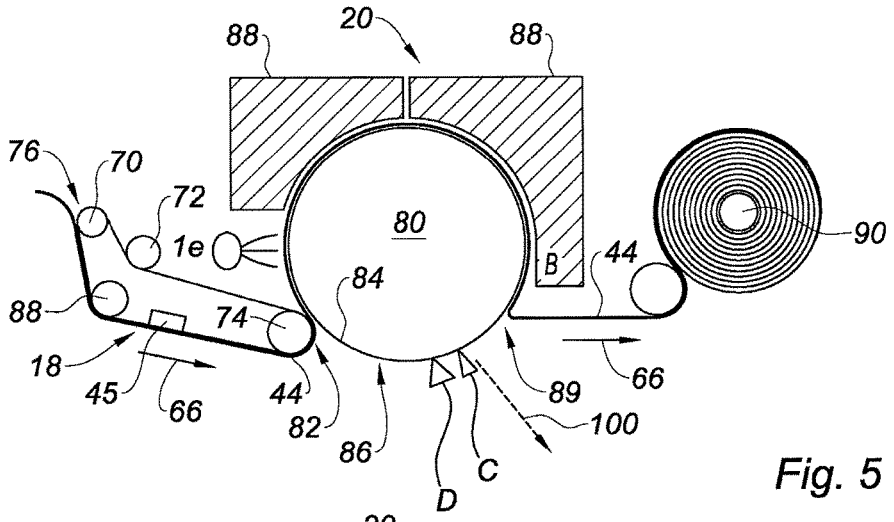
FIG. 5 is a schematic diagram of a section of a first papermachine showing an embodiment for applying an additive composition on a web at a Yankee cylinder.

FIGS. 3 to 5 show possible embodiments wherein the additive composition is applied during the papermaking step at the Yankee cylinder 80.

In FIG. 3, the additive composition is applied on the web downstream of the transfer nip 82 and upstream of the Yankee hood 88. The felt of the creping fabric 18 is diverted by means of rolls to have an access to the web and an additive composition applicator 1*b* is located in this diversion. In this embodiment, the coating composition is already applied on the Yankee cylinder and the web is adhered on the Yankee cylinder when the additive composition is sprayed.

In FIG. 4, the additive composition is applied on the Yankee cylinder 80 between the creping blade C and the nip 82. It can be applied, incorporated into the coating composition (FIG. 4*a*), or separately from the coating composition (FIG. 4*b*).

In an embodiment (FIG. 4*a*), the additive composition is incorporated into the coating composition and applied using the sprayed booms of the coating composition 1*c*. With the training of air and the rotation of the Yankee, the agent is sprayed. The resulting fog is driven quickly and the composition is applied to the Yankee cylinder. Then, the additive composition is transferred from the surface of the Yankee cylinder on the surface of the web when the web reaches the Yankee cylinder and pressure is applied by means of cylinder (s), presser (s) on the surface of the Yankee cylinder before going under the hood 88. This composition is so fixed on the web on the softer side that is in contact with the Yankee cylinder. Retention of the product is obtained in a range of 20 to 100%, or between 40% and 60%.

In the embodiment of the FIG. 4*b*, two applicators are necessary (1*d* and 2*d*), one for the additive composition and the other one for the coating composition. The order of the application is not important. Nevertheless, if the additive composition is applied second, the web is more impregnated and the composition does not need to be too concentrated in active and filming agents.

Concerning the application of the additive composition associated to the coating composition (together or separately), because the additive composition can have an adhesive or a release effect, one skilled in the art will adjust the mix and balance release/adhesive of the coating composition. Indeed, the coating composition includes adhesive agents for the adhesion of the web on the cylinder and/or release agents for the peeling and the creping, so it can be necessary to adjust the composition of the coating to obtain the expected result.

In these three previous embodiments, the application of the additive composition is upstream of the Yankee hood 88. Given that the temperature of the Yankee hood 88 is sufficient to change the state of the filming agent (i.e. between 50° C. and 200° C. or between 80° C. and 120° C.), it can be advantageously used in the same time to dry the web and change the state of the filming agent.

It is obviously possible to add a step of heating in addition to the Yankee hood. It is conceivable to obtain the sufficient temperature by using at least one heating cylinder or a metal plate or any other methods such as infrared, hot air, micro-wave. The heating cylinder and the metal plate can be heated by induction, steam, oil . . . . It can also be conceivable that the heating step is a through air drying step (TAD).

FIG. 5 shows another embodiment wherein the additive composition is applied with the applicator 1*e* during the papermaking step on the web which is on the surface of the Yankee cylinder 80 downstream of the transfer nip 82 and upstream of the Yankee hood 88. Contrary to FIG. 3, the felt of the creping fabric 18 is not diverted by means of rolls. In this embodiment, the coating composition is already applied on the Yankee cylinder and the web is adhered on the Yankee cylinder when the additive composition is sprayed.

Figure 6:
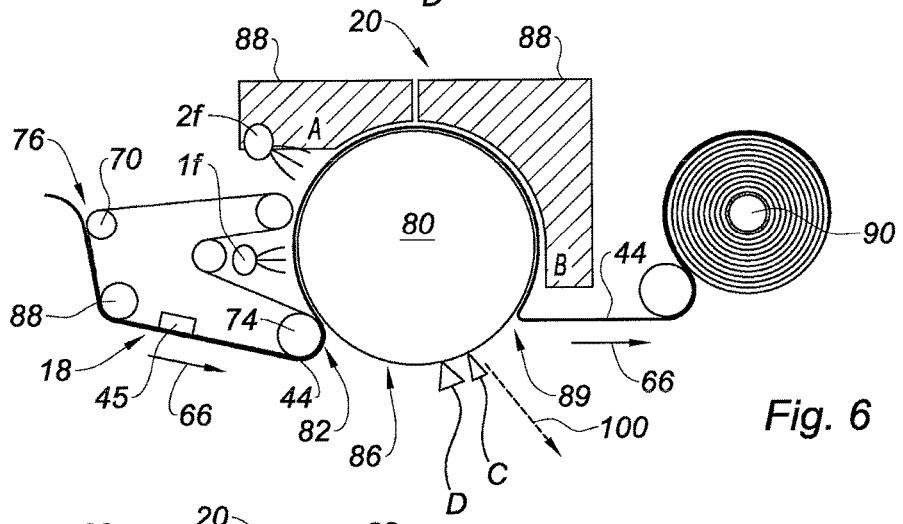
FIG. 6 is a schematic diagram of a section of a first papermachine showing an embodiment for applying with two applicators an additive composition on a web at a Yankee cylinder.

FIG. 6 shows another embodiment wherein, the additive composition is applied with two applicators 1*f* and 2*f* on a web at a Yankee cylinder during the papermaking step. The first applicator 1*f* is at the same location as the one in FIG. 3 and the second applicator is at the same location as the one in FIG. 5. In this embodiment, the coating composition is already applied on the Yankee cylinder and the web is adhered on the Yankee cylinder when the additive composition is sprayed.

Figure 7:
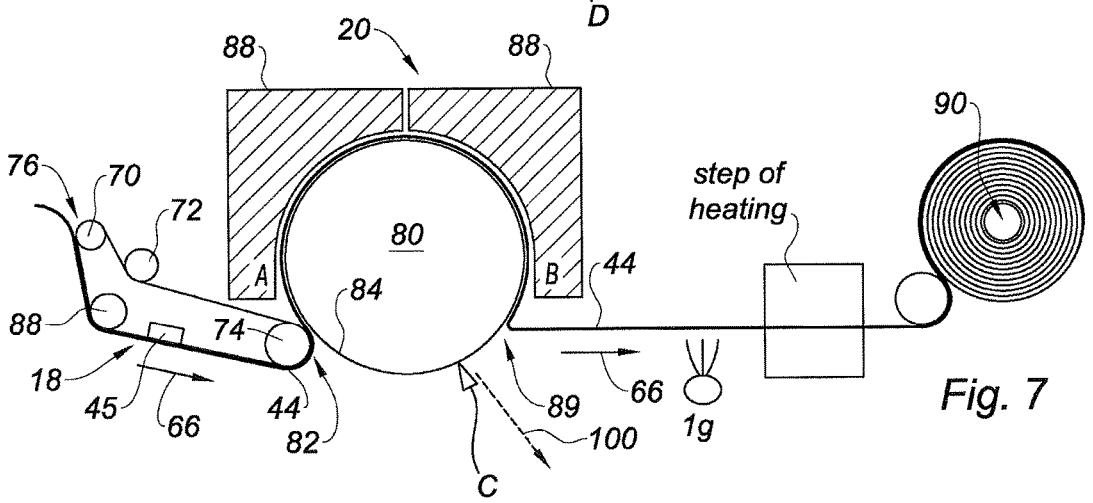
FIG. 7 is a schematic diagram of a section of a first papermachine showing an embodiment for applying an additive composition on a web downstream of a Yankee cylinder.

FIG. 7 shows another embodiment wherein, the additive composition is applied during the papermaking step on a dry web downstream of the Yankee cylinder 80.

In this embodiment, the additive composition is applied on a dried creped web with the applicator 1*g*. The additive composition is in suspension in water, so the web needs to be dried and especially heated at a sufficient temperature for the filming agent undergoes a change of state and retains the active agent on the web with the aim to not have its release, i.e. a temperature between 50° C. and 200° C. or between 80° C. and 120° C. The drying and the heating can be done in one step called "step of heating" in the embodiment of the FIG. 7. This temperature can be reached by using at least one heating cylinder or metal plate or any other methods such as infrared, hot air, Micro-wave.

The heating cylinder or the metal plate can be heated by induction, steam, oil.

In the case of the a TAD process, the additive composition can be applied as previously or at the TAD roll 160 and 164.

Then the web is wound on a take-up reel 90, to be used later in the converting step.

In the previous examples of embodiments, the additive composition is applied by spraying, but it can also be applied by slot nozzle or roll coating.

When the additive composition is applied after the wet-end process on a converting line, the web or ply can be treated before embossing and associating steps in the converting process. The final product includes at least one ply can also be treated in a final step of the converting process further to the embossing step.

It is obvious that the additive composition can be applied at any locations previously seen or at any combinations of these locations or it can be applied anywhere in the papermaking process. One skilled in the art will appreciate that the foregoing description is by way of example only and is not intended to limit the invention.

One skilled in the art will appreciated that the application step, the heating step or the method of application can be adapted in accordance with the expected product and the method used for the manufacture of the web.

Example 1

Knowing that an adhesive coating is applied by spraying onto the surface of the Yankee, the flow of the adhesive composition being 620 liters per hour and with 600 liters of water and 20 liters of coating, an additive composition including an antibacterial active agent was incorporated into the adhesive composition.

The breakdown was as follows:

550 liters of water, 20 liters of coating, and 50 liters of additive composition.

Efficiency of the invention can be more appreciated from tests on webs produced according to embodiments of the invention.

The webs were obtained from the application of an additive composition sprayed with the coating composition on the Yankee cylinder. The active agent of the additive composition is benzalkonium chloride, in a range of 0.5 to 1.5% associated with silver nitrate in a range of 0.2 to 1.0%; the filming agent in this test is from the family of copolymer of polyacrylate and polyvinylacetate, in a range of 0.2 to 1.5%. Then, the webs were converting into facial tissue and handkerchief.

Comparative tests were executed on two types of facial 4-ply tissue made of web (one with four treated plies and one with two inner treated plies) and other antiviral products (Products 1 to 3 as controls) to show whether or not the transfer of the active agent occurs. For each product, inhibition tests against one bacterium: *Bacillus subtilis* and one fungus: *Aspergillus niger* were made on both sides of the product as defined by the NF EN ISO 1104 standard. The detection with the naked eye of the presence of a zone of inhibition means a migration of the active agent beyond the sample of web, i.e. the active agent has been released from the web. The absence of a zone of inhibition means that the active agent has not been released and that it is not transferred. Results are summarized in the Table 1.

In the case of the first product, the product with all the three plies, as well as the inner ply alone are tested. In both cases, i.e. even when there are two outer plies not treated, the active agent is released from the web, killing the micro-organisms around the sample.

In the case of the second and third products, the release of the active agent is observed for *B. subtilis*.

Concerning the facial 4-ply tissue, two products are tested. Both are facial 4-ply tissues. In the first one, all the plies are treated, while in the second one, only the two inner plies are treated. The quantity of additive composition present on the tissue is 0.4 weight %. Both products are efficient against *B. subtilis* and *A. niger* and no release of the active agent is observed. Thus, it shows that the two products are efficient against bacteria and fungi and that it is not necessary with the present invention to treat all the webs of the products, a product with only two treated plies remains efficient. This test also shows that the treated sample can be directly in contact with the culture medium and no transfer of the active agent is observed around it. There is no need of no-treated outer plies to prevent the release of the active agent. The change of state of the filming agent with the step of heating is sufficient to achieve this result.

TABLE 1 comparative antibacterial and antifungal tests

| | *Bacillus subtilis* | | *Aspergillus niger* | |
|---|---|---|---|---|
| | Front Zone of inhibition | Back Zone of inhibition | Front Zone of inhibition | Back Zone of inhibition |
| Product 1 (3-ply) | Presence | Presence | Presence | Presence |
| Product 1 (inner ply alone) | Presence | Presence | Presence | Presence |
| Product 2 (3-ply) | Presence | Presence | Absence | Absence |
| Product 3 (hand towel) | Presence | Presence | Absence | Absence |
| Facial 4-ply with 4 treated plies/Invention | Absence | Absence | Absence | Absence |
| Facial 4-ply with 2 inner treated plies/Invention | Absence | Absence | Absence | Absence |

The antibacterial efficiency of facial tissue and handkerchief tissue is determined. The quantity of additive composition present on the tissue is 0.5 weight %.

Two bacteria's were tested: *Staphylococcus aureus* (*S. aureus*) and *Escherichia coli* (*E. coli*). The efficiency tests were made after 1 hour and after 4 hours. Antibacterial tests are made as defined by the NF EN ISO 20743 standard. The antibacterial efficiency is at least 94%. Results are summarised in Table 2.

TABLE 2 antibacterial efficiency

| | | Antibacterial Efficiency | | | |
|---|---|---|---|---|---|
| | | Inoculum: 1.76 $10^5$ *S. aureus* | | Inoculum 1.96 $10^5$ *E. coli* | |
| | Solution % Weight | Efficiency after 1 H | Efficiency after 4 H | Efficiency after 1 H | Efficiency after 4 H |
| Hanky 4-ply | 0.5% Wt | 94% | 97% | 97.6% | 99.17% |
| Facial 3-ply | 0.5% Wt | 96% | 98.6% | 97% | 99.96% |

The efficiency on long term is also confirmed. Antibacterial efficiency tests are made against *S. aureus* and *E. coli* with handkerchief tissue 4-ply. The web was made 1.5 years ago. The quantity of additive composition present on the tissue product is 0.5 weight %. After 1.5 years, the antibacterial efficiency is still good, higher than 60%. The results are summarized in Table 3.

TABLE 3 antibacterial efficiency on long term, after 1.5 years

| | | Antibacterial Efficiency | | | |
|---|---|---|---|---|---|
| | | Inoculum: 2.2 $10^7$ *S. aureus* | | Inoculum 2.2 $10^7$ *E. coli* | |
| | Solution % Weight | Efficiency after 1 H | Efficiency after 18 H | Efficiency after 1 H | Efficiency after 18 H |
| Hanky 4-ply | 0.5% Weight | 64% | 98% | 76% | 99.9% |

Example 2

In this example, antibacterial and antifungal efficiency is determined on a 4-ply handkerchief tissue. The active agent was applied in the converting step on the final product by a spraying equipment and followed by a heating step. The active agent of the additive composition is benzalkonium chloride, in a range of 0.5 to 1.5% associated or not with silver nitrate in a range of 0.2 to 1.0%; the filming agent in this test is from the family of copolymer of poly(acrylate) and poly(vinylacetate), in a range of 0.2 to 1.5%.

Results are summarised in Table 4 with benzalkonium chloride alone and in Table 5 with benzalkonium chloride associated to silver nitrate.

Two bacteria's were tested, *S. aureus* and *E. coli*, and a yeast, causing fungal infections, *Candida albicans* (*C. albicans*). The efficiency tests were made after 1 hour and after 18 hours as defined by the NF EN ISO 20743 standard. The antibacterial efficiency is above 95% and the antifungal efficiency is at least 85%, both for the benzalkonium chloride alone and the benzalkonium chloride associated to silver nitrate. We can also notice that the results are in accordance with those of the first example (Table 2) in which the additive composition was sprayed with the coating composition on the Yankee cylinder and followed by the converting step.

TABLE 4 antibacterial and antifungal efficiency with benzalkonium chloride

| | | Antibacterial Efficiency | | | | Antifungal Efficiency | |
|---|---|---|---|---|---|---|---|
| | | Inoculum: 2.50 $10^7$ *S. aureus* | | Inoculum 2.50 $10^7$ *E. coli* | | Inoculum 2.50 $10^7$ *C. albicans* | |
| | Solution % Weight | Efficiency after 1 H | Efficiency after 18 H | Efficiency after 1 H | Efficiency after 18 H | Efficiency after 1 H | Efficiency after 18 H |
| Hanky 4-ply | 0.5% Wt | 95.3% | 98.8% | 98.8% | 100% | 85.2% | 97.4% |

TABLE 5 antibacterial and antifungal efficiency with benzalkonium chloride associated to silver nitrate

| | | Antibacterial Efficiency | | | | Antifungal Efficiency | |
|---|---|---|---|---|---|---|---|
| | | Inoculum: 2.50 $10^7$ *S. aureus* | | Inoculum 2.50 $10^7$ *E. coli* | | Inoculum 2.50 $10^7$ *C. albicans* | |
| | Solution % Weight | Efficiency after 1 H | Efficiency after 18 H | Efficiency after 1 H | Efficiency after 18 H | Efficiency after 1 H | Efficiency after 18 H |
| Hanky 4-ply | 0.5% Wt | 95.6% | 99.1% | 99.6% | 100% | 85% | 98.8% |

The invention claimed is:

1. A web comprising:

a paper sheet comprising cellulosic fibers and having two sides; and a film comprising an additive composition on at least one side of the paper sheet, wherein the additive composition comprises at least one filming agent and at least one antimicrobial agent, wherein the active agent is retained on the web by the filming agent, and wherein the filming agent substantially comprises a non-water soluble polymer or a non-water soluble copolymer selected from the group consisting of polyacrylate, poly(vinyl)acetate, copolymer of acrylate and vinylacetate, copolymer of poly(acrylate) and vinylacetate, poly(vinylalcohol) of very high molecular weight, copolymer of vinyl alcohol and vinyl acetate, and polyamine-amide epychlorhydrin, as well as copolymers which contain the monomeric elements of the said polymers or a mixture of said polymers and copolymers.

2. The web according to claim 1, wherein the active agent is trapped on the web and is not released outside of the web, the release being measured in accordance with the NF EN ISO 1104 standard.

3. The web according to claim 1, wherein the filming agent comprises from 30 to 100% of non-water soluble polymer, copolymer or mixture thereof and from 0 to 30% of water-soluble polymer, copolymer or mixture thereof.

4. The web according to claim 3, wherein the water-soluble polymer or copolymer is selected from the group consisting of polyvinylpyrrolidone, copolymer of vinyl pyrrolidone and vinyl acetate, water soluble cellulose derivative, poly(vinylalcohol) of low and medium molecular weight, and polyethylenimine, and mixtures thereof.

5. The web according to claim 1, wherein the antimicrobial agent is an antibacterial or antifungal agent selected from the group consisting of benzalkonium chloride, dodecyl dimethyl ammonium chloride, cetylpyridinium chloride, hexadecyl trimethyl ammonium bromide, chlorhexidine, hexamidine, phenoxyethanol, triclosan, silver salts, and zinc salts and mixtures thereof.

6. The web according to claim 1, wherein the amount of filming agent present on the final product is between 0.01 weight % and 2 weight % and the amount of active agent present on the final product is between 0.005 weight % and 2 weight %.

7. The web according to claim 1, wherein antibacterial or antifungal efficiency of the final product, measured in accordance with the NF EN ISO 20743 standard, is at least about 60% after 1 h.

8. The web according to claim 1, wherein said web is a non woven web, airlaid paper sheet or wetlaid paper sheet.

9. The web according to claim 1, wherein said web has a basis weight between 10 and 200 g/$m^2$.

10. The web according to claim 1, wherein said web is a sheet of tissue paper with a basis weight between 10 and 80 g/$m^2$.

11. The web according to claim 1, wherein the film is a molecular layer on the cellulosic fibers located on the at least one side of the web.

* * * * *